United States Patent [19]

Langer et al.

[11] 4,365,933

[45] Dec. 28, 1982

[54] AXIAL VANE RING CONSISTING OF CERAMIC MATERIALS FOR GAS TURBINES

[75] Inventors: Manfred Langer, Gifhorn; Heinz Burfeindt, Wolfsburg, both of Fed. Rep. of Germany; Patrick Stuart, London, England

[73] Assignee: Volkswagenwerk Aktienbesellschaft, Wolfsburg, Fed. Rep. of Germany

[21] Appl. No.: 93,815

[22] Filed: Nov. 13, 1979

[30] Foreign Application Priority Data

Nov. 16, 1978 [DE] Fed. Rep. of Germany ..... 2849747

[51] Int. Cl.[3] ..... F01D 9/02

[52] U.S. Cl. ..... 415/217; 415/200

[58] Field of Search ..... 415/200, 214, 216, 217, 415/218; 416/241 B, 190, 191

[56] References Cited

U.S. PATENT DOCUMENTS

| | | | |
|---|---|---|---|
| 835,473 | 11/1906 | Rotter | 416/190 |
| 2,661,147 | 12/1953 | Anderson | 415/218 |
| 2,724,544 | 11/1955 | Hardigg | 415/217 |
| 3,867,065 | 2/1975 | Schaller et al. | 415/200 X |

FOREIGN PATENT DOCUMENTS

| | | | |
|---|---|---|---|
| 2756305 | 6/1978 | Fed. Rep. of Germany | 416/191 |

*Primary Examiner*—Leonard E. Smith

*Attorney, Agent, or Firm*—Brumbaugh, Graves, Donohue & Raymond

[57] ABSTRACT

A ceramic vane ring for a turbine rotor is provided with slits on the inner and outer cylinderical ceramic cover ring holding the vanes. The slits provide radial stress relief and prevent fractures arising out of thermal stresses in the ceramic vane ring.

10 Claims, 5 Drawing Figures

AXIAL VANE RING CONSISTING OF CERAMIC MATERIALS FOR GAS TURBINES

BACKGROUND OF THE INVENTION

The present invention relates to turbine vane rings, particularly ceramic vane rings for gas turbines composed of a plurality of vanes extending between radially inner and outer cylindrical cover rings.

It is known that the efficiency and the specific output of a gas turbine are related to the temperature of the working gases. Since the use of metallic materials for the gas-carrying components of a gas turbine limits the attainable gas temperatures by the relatively low heat resistance of metallic materials, it is recognized that the working temperatures, and thereby the efficiency and the specific output, of a gas turbine can be increased by making use of ceramic materials, such as silicon nitride, silicon carbide or aluminum titanate for high temperature components, such as the stator vane ring.

Difficulties have been encountered in fabricating such components from ceramic materials, since in addition to good aerodynamics of the flow paths, such components must have good manufacturing capability and high stability relative to the thermal stresses occurring at extreme operating conditions. It has been found that the vane rings of gas turbines are subjected to considerable heat stresses, particularly during the starting phase, and after shut down of the gas turbine from full load. One zone undergoing particular stress is the junction of the vanes and the outer cover ring, specifically in the vicinity of the axially trailing edges of the vane. These stresses can easily result in fractures, and can assume especially high values where vane rings are formed of a single piece, which is desirable from the point of view of leakage and integration into a gas turbine plant. Since such a monolithic vane ring, i.e., a vane ring consisting of one piece, is difficult to produce from ceramic materials, a method has become known whereby the vane ring is formed by connecting individual segments, each containing a vane and corresponding portions of the inner and outer cover rings. Such segments can be fabricated individually and subsequently held together by special means, such as bandages and the like. This type of vane ring construction necessitates a considerable effort in components and construction space.

It is, therefore, a purpose of the present invention to create a vane ring composed of ceramic materials for thermal flow machines, in particular for gas turbines, which offers an optimal design as regards heat stresses during rapidly changing operating conditions, as well as better aerodynamics, manufacturing capability and ease of fabrication.

SUMMARY OF THE INVENTION

In accordance with the present invention there is provided a ceramic vane ring for a turbine vane, comprising a plurality of ceramic turbine vanes radially extending between radially inner and outer cylindrical ceramic cover rings. Each of the cover rings has an equal plurality of radial stress relief slits arranged between the vanes, the slits extending substantially in the axial direction of the ring.

In a preferred arrangement the slits are midway between adjacent vanes and have at least the same axial location as the trailing edge of the vanes. In one embodiment the slits have an axial location corresponding to the trailing half of the vanes. The slits preferably have rounded end zones and may include foils of heat resistant material, in which case radially extending relief orifices are preferably provided at each end of the foils.

In accordance with a further aspect of the invention the outer cover ring may be provided with stress relief grooves in the vicinity of the junction of the vane and the ring. The grooves extend axially and have a preferred circumferential width equal to approximately 40–60% of the circumferential vane spacing. The walls of the grooves can be arranged to extend parallel to the contours of the turbine vanes. The groove has a preferable depth such that the remaining radial thickness of the outer cover ring in the vicinity of the grooves corresponds approximately to the average profile thickness of the vane, while the radial thickness of the outer cover ring in other regions is approximately 3–10 times the average profile thickness of the vanes. In another embodiment the outer cover ring has a radial thickness corresponding approximately to the average profile thickness of the vanes and there is provided an annular cover band surrounding the radial outer surface and having grooves in the vicinity of the vanes.

In accordance with the invention there is also provided a process for providing a ceramic vane ring by the steps of forming individual segments, each comprising one vane and corresponding portions of radially inner and outer cover rings. The segments are arranged into a ring while in their green state and are thereafter joined by a selected connecting process.

Calculations and tests carried out by the inventors have shown that the vane ring in accordance with the invention provides a decisive reduction of the thermal stresses occurring in the vanes and the cover ring. In the zone of the vane trailing edges, there is a stress reduction which facilitates the use of ceramic materials, such as silicon carbide, silicon nitride or aluminum titanate. The most important aspect is the fact that the edge stresses can be decisively reduced by means of essentially axial relief slits, which are provided at least in the axial area of the cover rings associated with the vane trailing edge. In addition to this reduction of the thermal stresses, it has been found that the leakage losses of vane rings of this kind are not substantially larger than those of monolithic vane rings, since the slits do not need to extend over the entire axial length of the cover ring. Finally, the vane ring in accordance with the invention is distinguished by favorable producibility, because, in accordance with the method of the invention, each vane segment is individually formed, and the associated single segments, each containing corresponding portions of the radially outer and inner cover ring sections of the vane ring, are combined in their green state to form a complete ring. Subsequently, the cover ring sections, leaving the slits between the segments, are joined with one another by means of a selected bonding method, e.g., by nitriding, cementing or the like. A turbine vane ring produced in this manner can be manufactured substantially easier, and at lower cost than a monolithic vane ring, since only one single tool is required to form all of the vane segments. Furthermore, a vane ring according to the invention, by reason of the connection of the segments over a part of their axial length, comprises a quasi-monolithic ceramic structure. Thus the unit has greater structural integrity and offers favorable possibilities for integration into a gas turbine engine.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
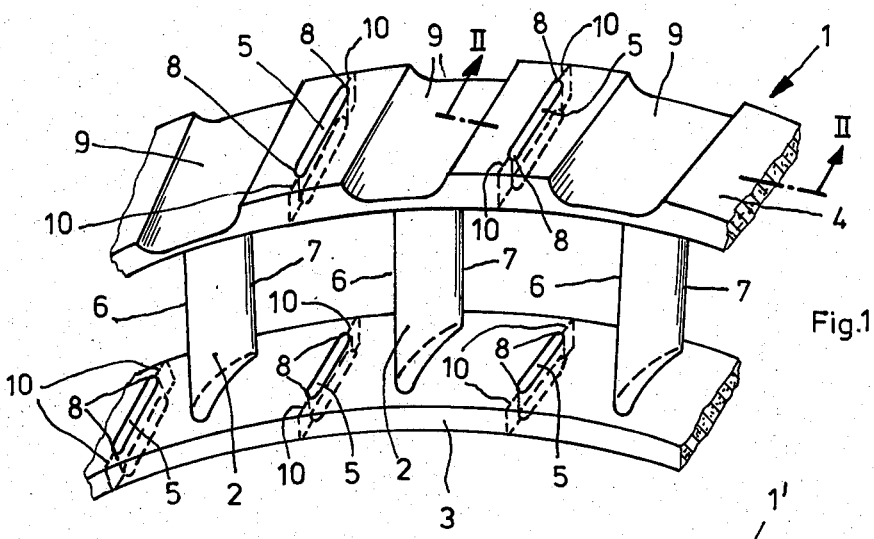
FIG. 1 is an isometric view of a portion of a ceramic vane ring in accordance with the present invention.
Figure 2:
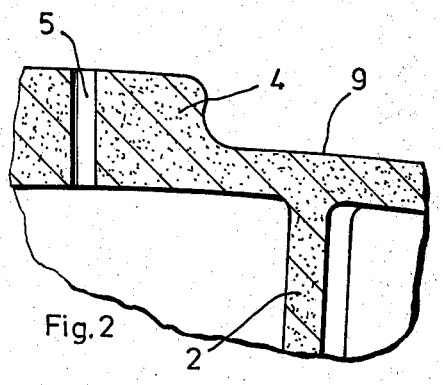
FIG. 2 is a partial section, with enlarged scale, through the FIG. 1 vane ring, along the lines II—II.

Referring to the drawings, similar components in the various embodiments are designated by the same reference numerals, in some cases with a prime. In FIGS. 1 and 2 there is shown a ceramic turbine vane ring 1 for use in a gas turbine. The ring includes vanes 2, a cylindrical radially inner ring 3 and a radially outer cover ring 4. In the cylindrical cover rings 3 and 4 there are provided slits 5 which are centered between adjacent vanes 2. Slits 5 have rounded end zones. The slits 5 extend radially through the entire thickness of cover rings 3 and 4, respectively, but do not extend over the entire axial length of the cover rings so that the cover rings maintain the vane ring as an integral assembly. Specifically, the invention provides that the slits are furnished at least on the axial level of the trailing edges 7 of the vanes 2 on the cover rings 3 and 4. That is, the axial extent of the slits include axial position values corresponding to the trailing edge 7 of the vanes 2. The zone of the vane leading edges 6, on the other hand, is not as critical with respect to the thermal stresses occurring during operation.

Figure 3:
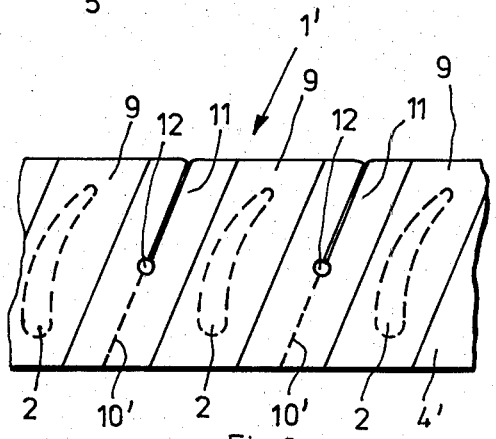
FIG. 3 is a partial radial inward view of another vane ring in accordance with the present invention.
Figure 4:
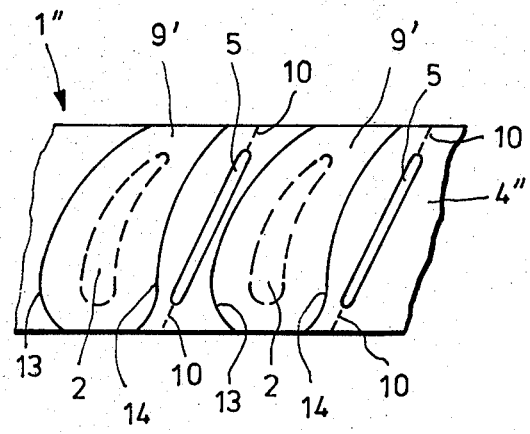
FIG. 4 is a partial radial inward view of still another vane ring in accordance with the present invention.

In the embodiments shown in FIGS. 1 to 4, the radially outer cylindrical cover ring 4 is provided with axially extending grooves 9 in the zone of the junctions of the ring 4 and the vanes 2 on its radially outer peripheral surface. These grooves 9 may have straight walls, as illustrated in FIG. 3, or as shown in FIG. 4, may have contoured walls 13, 14 conforming to the contours of the surfaces of vane 2. The width of the grooves in the circumferential direction is approximately 40 to 60% of the vane separation, i.e., the center to center distance of two adjacent vanes from each other.

FIG. 2 shows the zone of transition from the vane 2 to the outer cover ring 4 on an enlarged scale. The grooves 9 serve to prevent the accumulation of heat in the transition zone between the vane profile and the cover ring, which would result in considerable temperature gradients and thermal stresses caused thereby. In particular, these gradients and stresses might arise in cases of extremely unsteady operating states, such as starting and stopping of the gas turbine from the full load range. The groove 9 is dimensioned so that the radial thickness of the cover ring 4, remaining in this zone, corresponds to approximately the mean profile thickness of the vanes 2; while the region outside the grooves 9 have a radial thickness of approximately 3 to 10 times the value of the mean vane profile thickness.

FIG. 3, moreover, shows that the slits in the cover ring 4' may also be formed by insertion of foils 11 of a heat resistant material such as platinum inserted between the cover ring segments. The foil here is provided in the zone of the cover ring which is situated on the level of the rear half of the vane 2. That is, the foil extends from an axial position corresponding to the center of vanes 2 at least to an axial position corresponding to the trailing edge 7 of vanes 2. In the end region of the foil 11 located approximately in the center of the cover ring, a relief orifice 12 is provided in the cover ring which, like the roundings 8 of the slits 5 of the embodiment shown in FIG. 1, are to largely prevent the occurrence of notch stresses.

The vane rings in accordance with the invention may be produced by first fabricating from ceramic material individual vane ring segments, each containing a vane and the peripheral portion of the cover rings 3 and 4 associated therewith. Suitable materials are silicon nitride, silicon carbide or also aluminum titanate. Fabrication may be by injection molding or the like. These individual segments are arranged into a ring in their so-called green state and are joined by means of a bonding method compatible with the ceramic material. The joints 10 and 10' indicated in the drawings are thereby formed connecting the vane ring segments except where connection of the segments is prevented in the zones of the slits 5 or where the segments are separated by the foils 11.

As a specific example, vane ring segments composed of silicon nitride or silicon carbide may be produced by injection molding, after which the partial joint surfaces of the segments to be connected, while still in their green state, are partly dissolved by means of a plasticizer and subsequently cemented together. Subsequently, the plasticizer is removed by burning-out and finally, nitration or siliconizing is carried out.

As another example, the vane ring segments may be produced by means of a slip casting method, and surfaces to be jointed may be levigated with the material of the component proper, and may be cemented together by drying. Final sintering, nitration or siliconizing will then yield the finished vane ring. Cementing of the joint surfaces would also be possible following final sintering of the vane ring segments by making use of, e.g., chemically-ceramically binding or sinterable oxide or non-oxide cements, whereby the cement must be compatible with the properties of the basic material of the segments.

Figure 5:
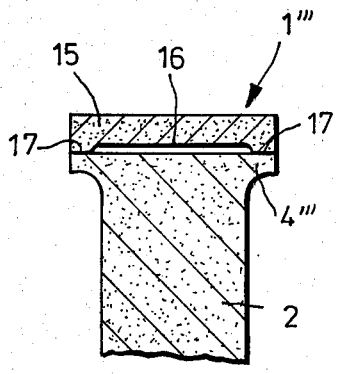
FIG. 5 is a radial cross-sectional view of another vane ring in accordance with the present invention.

FIG. 5, finally, shows an embodiment of the vane ring wherein, contrary to the aforedescribed constructions, the segments 4''' forming the cover ring are surrounded by a ring-shaped cover band 15 likewise consisting of ceramic material. The said cover band is provided in a zone corresponding to the vane junction with a circumferential annular groove 16 with rounded end regions, and is joined, again by means of material-compatible cementing, with the cover ring segments 4''' only in the lateral edge zones 17. In order to avoid heat accumulation problems, the radial thickness of the cover ring corresponds to the mean profile thickness of the vane. The individual vane ring segments need not be joined with one another, since each of them is joined with the cover band, and thus, they are held together in an assembly.

The advantage of this construction lies in the fact that the outer cover ring no longer has an outer discontinuous peripheral surface, but is a round and smooth surface, and thus can easily be integrated into the running gear of the turbine.

While there have been described what are believed to be the preferred embodiments of the invention, those skilled in the art will recognize that other and further modifications may be made thereto without departing from the spirit of the invention, and it is intended to claim all such embodiments as fall within the true scope of the invention.

We claim:

1. A ceramic vane ring for a turbine, comprising a plurality of ceramic turbine vanes radially extending between and joined with radially inner and outer ceramic cover rings, each of said cover rings having a radial stress relief slit arranged between each vane, said slits extending substantially in the axial direction of said ring and arranged at least in the same axial location as the trailing edge of said vanes, and wherein the radially outer surface of said outer cover ring is provided with stress relief grooves in the vicinity of the junction of said vanes and said outer ring.

2. A vane ring as specified in claim 1, wherein said slits are arranged approximately midway between said vanes.

3. A vane ring as specified in claim 1, wherein said slits have an axial location on said rings corresponding to the trailing half of said vanes.

4. A vane ring as specified in claim 1 or claim 2, wherein said slits have rounded end zones.

5. A vane ring as specified in claim 1 or claim 2, wherein said slits include foils of heat-resistant material enclosed in said cover rings.

6. A vane ring as specified in claim 5, wherein said cover rings are provided with radially extending relief orifices at least at one end of said foils.

7. A vane ring as specified in claim 1, wherein said grooves extend essentially axially, and have a circumferential width approximately 40 to 60% of the circumferential vane spacing.

8. A vane ring as specified in claim 1, wherein the walls of said grooves extend essentially parallel to the contours of said vanes.

9. A vane ring as specified in claim 1, 7 or 8, wherein said outer cover ring, in the vicinity of said grooves has a radial thickness which corresponds approximately to the average profile thickness of said vanes.

10. A vane ring as specified in claim 1, 7 or 8, wherein said outer cover rings in regions other than said grooves has a radial thickness of approximately 3 to 10 times the average profile thickness of said vanes.

* * * * *